United States Patent [19]

DuBois

[11] 4,309,968

[45] Jan. 12, 1982

[54] FUEL PRIMER AND ENRICHMENT SYSTEM FOR AN INTERNAL COMBUSTION ENGINE

[75] Inventor: Chester G. DuBois, Zion, Ill.

[73] Assignee: Outboard Marine Corporation, Waukegan, Ill.

[21] Appl. No.: 60,287

[22] Filed: Jul. 25, 1979

[51] Int. Cl.[3] ..... F02M 1/16

[52] U.S. Cl. ..... 123/187.5 R; 123/179 G; 123/179 L

[58] Field of Search ..... 123/179 L, 187.5 R, 123/179.6, 180 R, 73 R, 73 A, 73 C

[56] References Cited

U.S. PATENT DOCUMENTS

| | | | |
|---|---|---|---|
| 1,123,643 | 2/1915 | Wetmore | 123/187.5 R |
| 1,187,977 | 6/1916 | Demers | 123/187.5 R |
| 1,240,404 | 9/1917 | Aull | 123/187.5 R |
| 1,322,674 | 11/1919 | Desmond | 123/187.5 R |
| 1,364,823 | 1/1921 | Aull | 123/187.5 R |
| 1,468,162 | 9/1923 | Le Maire | 123/187.5 R |
| 1,624,139 | 4/1927 | Ketterino | 123/187.5 R |
| 1,658,115 | 2/1928 | Cavanagh | 123/187.5 R |
| 1,668,209 | 5/1928 | Jorgensen | 123/185.5 R |
| 2,412,532 | 12/1946 | Parker | 123/187.5 R |
| 2,450,295 | 9/1948 | Parker | 123/187.5 R |
| 2,762,355 | 9/1956 | Jones | 123/187.5 R |
| 2,788,781 | 4/1957 | Frisch | 123/187.5 R |
| 3,978,839 | 9/1976 | DuBois | 123/187.5 R |
| 3,985,113 | 10/1976 | DuBois | 123/187.5 R |
| 4,194,483 | 3/1980 | McChesney | 123/187.5 R |
| 4,204,511 | 5/1980 | Morris | 123/187.5 R |

*Primary Examiner*—Ira S. Lazarus
*Assistant Examiner*—Carl Stuart Miller
*Attorney, Agent, or Firm*—Michael, Best & Friedrich

[57] ABSTRACT

An engine comprises a combustion chamber and a first fuel delivery system which communicates with the combustion chamber and which is adapted for connection with a fuel source. The first fuel delivery system is operative for introducing fuel from the source into the combustion chamber. A second fuel delivery system also communicates with the combustion chamber and is adapted for connection with a fuel source. The second fuel delivery system is operative for introducing fuel from the source into the combustion chamber in addition to the fuel introduced by said first fuel delivery system. The second fuel delivery system includes a fuel pump for pumping fuel through the second fuel delivery system. A control mechanism is movable in the second fuel delivery system for controlling the introduction of fuel into the combustion chamber by the second fuel delivery system during operation of the fuel pump as well as for manually pumping fuel through the second fuel delivery system independent of operation of the fuel pump.

23 Claims, 2 Drawing Figures

FUEL PRIMER AND ENRICHMENT SYSTEM FOR AN INTERNAL COMBUSTION ENGINE

FIELD OF THE INVENTION

The invention generally relates to internal combustion engines and, more particularly, to fuel priming and enrichment systems for use with internal combustion engines.

DESCRIPTION OF THE PRIOR ART

Attention is directed to the following United States patents which generally disclose fuel priming systems for internal combustion engines:

| | | |
|---|---|---|
| Wetmore | 1,128,643 | February 16, 1915 |
| Demers | 1,187,977 | June 20, 1916 |
| Aull | 1,240,404 | September 18, 1917 |
| Desmond | 1,322,674 | November 25, 1919 |
| Aull | 1,364,823 | January 4, 1921 |
| LeMarie | 1,468,162 | September 18, 1923 |
| Kattering | 1,624,139 | April 12, 1927 |
| Cavanagh | 1,658,115 | February 7, 1928 |
| Jorgensen, et al | 1,668,209 | May 1, 1928 |
| Parker, et al | 2,412,523 | December 10, 1946 |
| Parker, et al | 2,450,295 | September 28, 1948 |
| Jorgensen, et al | 2,707,921 | May 10, 1955 |
| Jones | 2,762,355 | September 11, 1956 |
| Frisch | 2,788,781 | April 16, 1957 |
| Reichenbach, et al | 3,415,236 | December 10, 1968 |

SUMMARY OF THE INVENTION

The invention provides an engine comprising a combustion chamber and first fuel delivery means which communicates with the combustion chamber and which is adapted for connection with a fuel source, the first fuel delivery means being thereby operative for introducing fuel from the fuel source into the combustion chamber. Second fuel delivery means also communicates with the combustion chamber and is also adapted for connection with a fuel source. The second fuel delivery means is thereby operative for introducing fuel from the source into the combustion chamber in addition to the fuel which is introduced into the combustion chamber by the first fuel delivery means. The second fuel delivery means includes first fuel pumping means for pumping fuel through the second fuel delivery means. Means is movable in the second fuel delivery means for controlling the introduction of fuel into the combustion chamber by the second fuel delivery means during operation of the first fuel pumping means as well as for pumping fuel through the second fuel delivery means in response to movement of the means in the second fuel delivery means.

In one embodiment of the invention, the means which is movable in the second fuel delivery means includes control means which is operatively movable in the second fuel delivery means in a first direction for permitting the introduction of fuel into the combustion chamber by the second fuel delivery means during operation of the first fuel pumping means and in a second direction for blocking the introduction of fuel into the combustion chamber by the second fuel delivery means, notwithstanding operation of the first fuel pumping means. In this embodiment, the means which is movable in the second fuel delivery means also includes second fuel pumping means which is operatively connected with the control means for pumping fuel through the second fuel delivery means independent of operation of the first fuel pumping means in response to sequential movement of the control means in the first direction and in the second direction.

In one embodiment of the invention, the control means is movable between a first position blocking the introduction of fuel into the combustion chamber by the second fuel delivery means, a second position spaced in the first direction from the first position and permitting the introduction of fuel into the combustion chamber by the second fuel delivery means, and a third position spaced in the first direction from the second position and permitting the introduction of fuel into the combustion chamber by the second fuel delivery means. In this embodiment, the second fuel pumping means is operative for pumping fuel through the second fuel delivery means in response to sequential movement of the control means in the first direction from the second position toward the third position and in the second direction from the third position toward the second position.

In one embodiment of the invention, the first fuel delivery means includes a carburetor having a fuel chamber communicating with the fuel source and an air induction passage communicating with the atmosphere and with the combustion chamber. In this embodiment, the second fuel delivery means has an inlet end which communicates with the fuel chamber and an outlet end which communicates with the air induction passage.

In one embodiment of the invention, the combustion chamber includes a sidewall having an inlet port passing therethrough. In this embodiment, the outlet end of the second fuel delivery means includes nozzle means which communicates with the inlet port of the combustion chamber for introducing fuel directly into the combustion chamber through the inlet port.

In one embodiment of the invention, the control means includes spring means for returning the control means from the third position toward the second position.

In one embodiment of the invention, the control means includes locking means for selectively securing the control means in the first position.

In one embodiment of the invention, the second fuel delivery means includes a main fuel supply passage, an inlet branch passage having an intake end communicating with the source and a discharge end communicating with the main fuel supply passage, and an outlet branch passage having an intake end communicating with the main fuel supply passage and a discharge end communicating with the combustion chamber. In this embodiment, the control means is movable in the main fuel supply passage between the first position which prevents communication between the inlet branch passage and the outlet branch passage and the second and third positions which both afford communication between the inlet branch passage and the outlet branch passage.

In one embodiment of the invention, the main fuel supply passage includes oppositely spaced first and second ends. In this embodiment, the discharge end of the inlet branch passage communicates with the main fuel supply passage generally intermediate the first end and the second end, and the intake end of the outlet branch passage communicates with the main fuel supply passage generally adjacent to the first end. In this embodiment, the control means includes a piston movable in the main fuel supply passage between the first position in which the piston is located generally adjacent to the first end of the main fuel supply passage between the inlet branch passage and outlet branch passage, thereby blocking communication therebetween, the second position in which the piston is located generally between the inlet branch passage and the second end of the main fuel supply passage, thereby affording communication between the inlet and outlet branch passages, and the third position in which the piston is located generally adjacent to the second end of the main fuel supply passage. In this embodiment, the second fuel pumping means includes check valve means which communicates with the inlet branch passage and the outlet branch passage so that movement of the piston from its second position toward its third position draws fuel through the inlet branch passage from the source into the main fuel supply passage and movement of the piston from its third position toward its second position expels fuel through the outlet branch passage from the main fuel supply passage into the combustion chamber.

In one embodiment of the invention, the discharge end of the inlet branch passage generally communicates with the main fuel supply passage adjacent to the first end, and the intake end of the outlet branch generally communicates with the main fuel supply passage generally adjacent to the second end. In this embodiment, the control means includes a piston movable in the main fuel supply passage between the first position in which the piston is located generally adjacent to the inlet branch passage between the inlet branch passage and outlet branch passage, the second position in which the piston is located generally equidistant between the inlet and outlet branch passages, and the third position in which the piston is located generally adjacent to the outlet branch passage between the inlet branch passage and the outlet branch passage. A piston rod extends from the piston through the second end of the main fuel supply passage. The piston rod has an auxiliary passage formed therein with a first open end communicating with an inlet chamber portion of the main fuel supply passage formed between the piston and the first end of the main fuel supply passage and a second open end communicating with an outlet chamber portion of the main fuel supply passage formed between the piston and the second end of the main fuel supply passage. In this embodiment, the control means includes means for blocking communication between the inlet chamber portion and the outlet chamber portion when the piston is in its first position, thereby blocking communication between the inlet branch passage and the outlet branch passage, and for affording communication between the inlet chamber portion and the outlet chamber portion through the auxiliary passage when the piston is in its second and third positions, thereby affording communication between the inlet branch passage, and outlet branch passage through the auxiliary passage. The second fuel pumping means includes check valve means which communicates with the auxiliary passage and the outlet branch passage so that movement of the piston from its second position toward its third position draws fuel from the source into the inlet chamber portion through the inlet branch passage while at the same time expels fuel from the outlet chamber portion into the combustion chamber through the outlet branch passage. Also by virtue of the check valve means, movement of the piston from its third position toward its second position draws fuel through the auxiliary passage from the inlet chamber portion of the main fuel supply passage into the outlet chamber portion thereof.

In one embodiment of the invention, the engine includes a second combustion chamber, and the control means are associated second fuel pumping means are operative to control the introduction of fuel through the second fuel delivery means into both first and second combustion chambers as well as simultaneously pump fuel into both first and second combustion chambers in response to movement of the control means in the second fuel delivery means.

One of the principal features of the invention is the provision of an engine having a primary fuel delivery system as well as a secondary fuel delivery system which is operative for selectively enriching the quantity of fuel delivered by the primary fuel delivery system during normal engine operations as well as for priming the engine prior to and during cranking operations.

Another one of the principal features of the invention is the provision of an engine having a secondary fuel delivery system which includes a straightforward, unitary control mechanism which is movable between first and second operational positions to control the flow of fuel through the secondary fuel delivery system subject to the operation of an associated fuel pumping mechanism as well as sequentially movable between the second operational position and a third operational position to manually pump fuel through the secondary fuel delivery system independent of operation of the fuel pumping mechanism.

Other features and advantages of the embodiments of the invention will become known by reference to the following general description, claims, and drawings.

Figure 1:
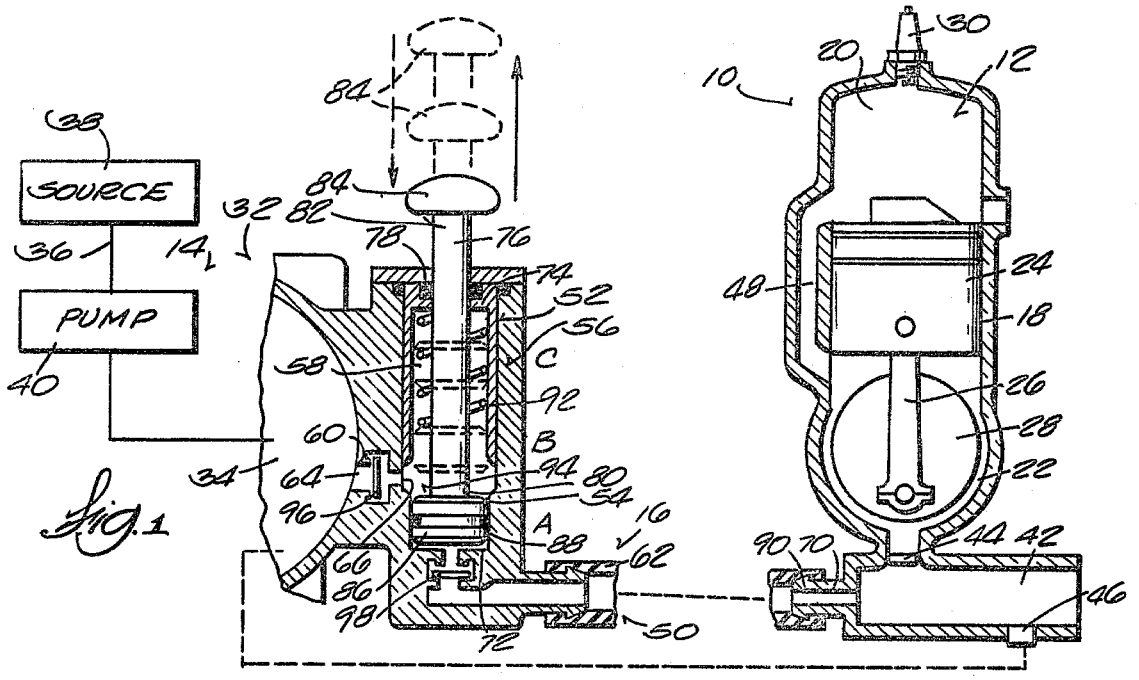
FIG. 1 is a diagrammatic view of an internal combustion chamber having a fuel priming and enrichment system which embodies various of the features of the invention.

Before explaining the embodiments of the invention in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology employed herein is for the purpose of description and should not be regarded as limiting.

GENERAL DESCRIPTION

Shown in FIG. 1 is an internal combustion engine 10 which embodies various of the features of the invention. Generally, the engine 10 includes a combustion chamber 12 and associated first and second fuel delivery means, respectively 14 and 16, which together or separately introduce fuel into the combustion chamber 12 to sustain engine operation.

While various engine constructions are possible, in the illustrated embodiment, a block member 18 includes a cylinder 20 which defines the combustion chamber 12. The block member 18 also includes a crankcase 22 which extends from the cylinder 20. A piston 24 is mounted for reciprocative movement inside the cylinder 20, being connected by a connecting rod 26 to a crankshaft 28 which is rotatably mounted in the crankcase 22. A spark plug 30 or the like extends into the combustion chamber 12, and fuel which is introduced into the combustion chamber 12 by either the first or second fuel delivery means 14 or 16 is ignited by the spark plug 30, thereby causing reciprocative movement of the piston 24 which in turn drives the crankshaft 28.

The first fuel delivery means 14 may be variously constructed. In the illustrated embodiment, a carburetor 32 having a fuel chamber 34 is provided, and a fuel conduit 36 communicates with a source of fuel 38 and the fuel chamber 34 for carrying fuel into the fuel chamber 34. Primary fuel pumping means 40, such as a mechanical or pulse-activated fuel pump, is connected in line with the fuel conduit 36 for pumping fuel into the fuel chamber 34 in response to piston reciprocation.

The carburetor 32 also includes an air induction passage 42 which directs air from the atmosphere into the crankcase 22, typically through a conventional reed valve assembly 44. As air flows through the air induction passage 42 toward the crankcase 22, fuel is drawn from the fuel chamber 34 into the air induction passage 42 through a suitable fuel metering orifice 46. An air-fuel mixture is thereby formed in the air induction passage 42 and is drawn through the reed valve assembly 44 and a fuel induction port 48 into the combustion chamber 12 in response to pulsating pressure variations which occur in the crankcase 28 during piston reciprocation. It should now be apparent that the first fuel delivery means 14 represents the primary fuel supply system of the engine 10.

When the engine 10 is cold or has been inoperative for some time, it is often desirable to supplement or enrich the quantity of combustible fuel which is normally delivered to the combustion chamber 12 through the first fuel delivery means 14. This enriched flow of fuel serves to prime the engine 10 to facilitate initial starting operations as well as serves to improve engine performance after the engine 10 has started and before normal operating temperatures are reached. The second fuel delivery means 16 is provided for selectively introducing fuel into the combustion chamber 12 in addition to the fuel which is introduced by the first fuel delivery means 14 to supplement or enrich the quantity of combustible fuel during these periods prior to and after starting.

Figure 2:
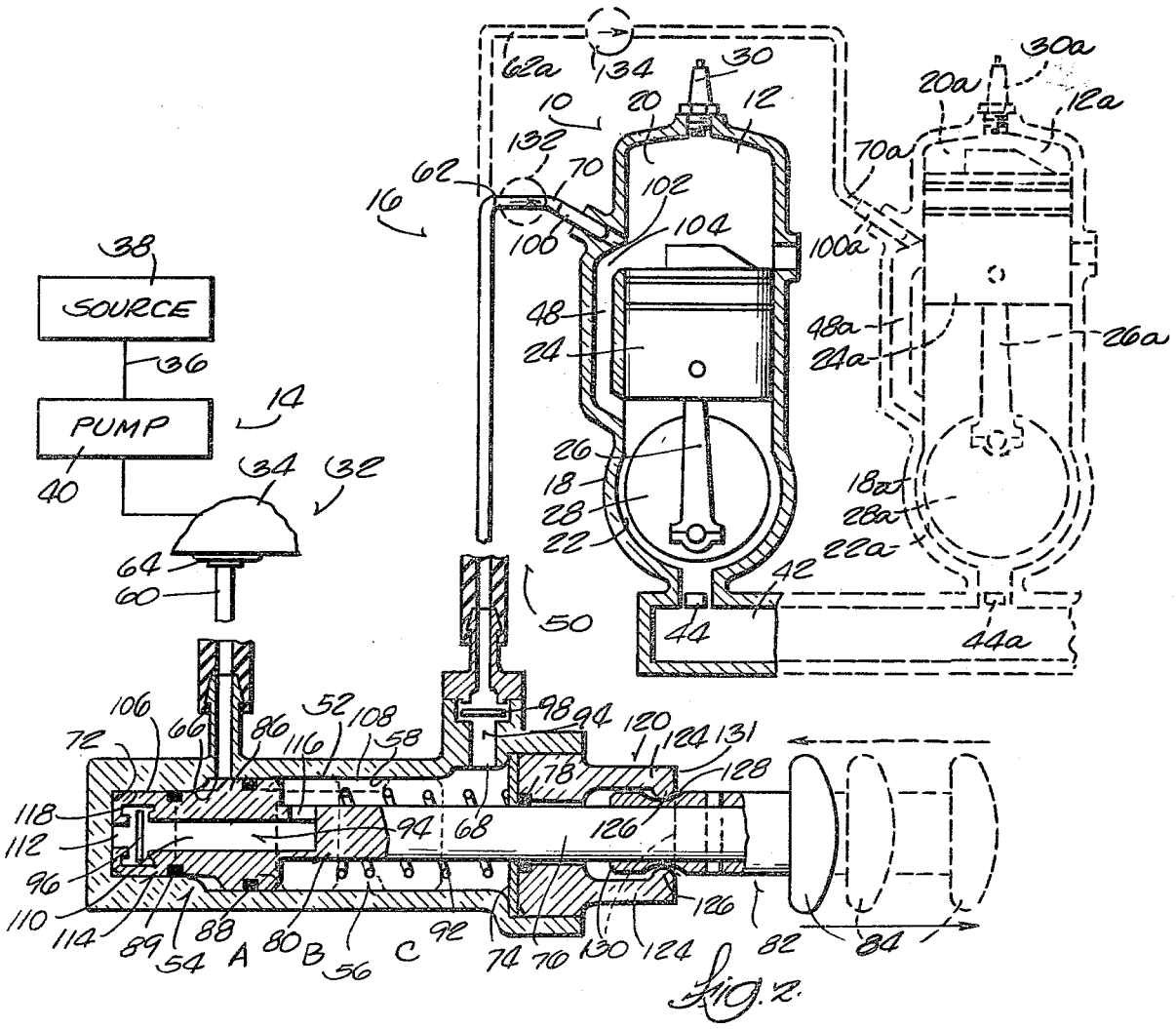
FIG. 2 is a diagrammatic view of an internal combustion engine in which second and third alternate embodiments of the fuel priming and enrichment system are shown.

While the second fuel delivery means 16 may be variously constructed, in FIGS. 1 and 2, the second fuel delivery means 16 generally communicates with the source of fuel 38 and with the combustion chamber 12 and includes first fuel pumping means 50 for pumping fuel through the second fuel delivery means 16. Means 52 is movable in the second fuel delivery means 16 for controlling the introduction of fuel into the combustion chamber 12 through the second fuel delivery means 16 during operation of the first fuel pumping means 50. The means 52 is also movable in the second fuel delivery means 16 for pumping fuel through the second fuel delivery means 16 independently of the first fuel pumping means 50.

While the means 52 which both controls the introduction of fuel through the second fuel delivery means 16 during operation of the first fuel pumping means 50 as well as pumps fuel through the second fuel delivery means 16 independently of the first fuel pumping means 50 may be variously constructed, in FIGS. 1 and 2, the means 52 generally includes control means 54 which is operatively movable in a first direction (as shown by solid line arrows in FIG. 1 and 2) for permitting the introduction of fuel into the combustion chamber 12 through the second fuel delivery means 16 during operation of the first fuel pumping means 50 and in a second direction (as shown by phantom line arrows in FIGS. 1 and 2) for blocking the introduction of fuel into the combustion chamber 12 through the second fuel delivery means 16, notwithstanding operation of the first fuel pumping means 50. In addition, the means 52 generally includes second fuel pumping means 56 which is operatively connected with the control means 54 for pumping fuel through the second fuel delivery means 16 in response to sequential movement of the control means 54 in the first direction and in the second direction.

More particularly, and as shown in both FIGS. 1 and 2, the second fuel delivery means 16 includes a main fuel supply passage 58 which communicates with the source of fuel 38 and with the combustion chamber 12 through associated inlet and outlet branch passages, respectively 60 and 62. The inlet branch passage 60 has an intake end 64 which communicates with the fuel source 38 and a discharge end 66 which communicates with the main fuel supply passage 58. Correspondingly, the outlet branch passage 62 has an intake end 68 which, like the discharge end 66 of the inlet branch passage 60, communicates with the main fuel supply passage 58, and a discharge end 70 which communicates with the combustion chamber 12.

The control means 54 is generally movable in the main fuel supply passage 58 between three generally spaced operational positions. When the control means 58 is situated in the first position (as shown by solid lines as position A in FIGS. 1 and 2), communication between the discharge end 66 of the inlet branch passage 60 and the intake end 68 of the outlet branch passage 62 is blocked. Consequently, the flow of fuel from the source 38 into the combustion chamber 12 through the main fuel supply passage 58 is blocked.

The second position of the control means 54 (as shown by phantom lines as position B in FIGS. 1 and 2) is spaced in the first direction from the just described first position and affords communication between the discharge end 66 of the inlet branch passage 60 and the intake end 68 of the outlet branch passage 62 through the main fuel supply passage 58. Consequently, the flow of fuel from the source 38 into the combustion chamber 12 through the main fuel supply passage 58 is unobstructed.

The third position of the control means 54 (as indicated by phantom lines as position C in FIGS. 1 and 2) is spaced in the first direction from the just described second position and, like the second position, affords communication between the discharge end 66 of the inlet branch passage 60 and the intake end 68 of the outlet branch passage 62.

As will soon be described in greater detail, the second fuel pumping means 56 is operative in response to sequential movement of the control means 54 in the main fuel supply passage 58 in the first direction from the second position towards the third position (that is, from position B toward position C in FIGS. 1 and 2) and in the second direction from the third position toward the second position (that is, from position C toward position B in FIGS. 1 and 2) to pump fuel into the combustion chamber 12.

While the particular construction of the second fuel delivery means 16, the control means 54 and the associated second fuel pumping means 56 may vary, three alternate embodiments are illustrated in the drawings.

Referring first to FIG. 1 and the first embodiment shown therein, the main fuel supply passage 58 takes the shape of a cylinder having a first end 72 and an oppositely spaced second end 74. The control means 54 generally includes a plunger mechanism movable between the first and second ends 72 and 74 of the cylindrical main fuel supply passage 58. The plunger mechanism 54 includes a rod 76 which is movably mounted in a gasket-lined aperture 78 formed in the second end 74 of the main fuel supply passage 58. The rod 76 includes an end portion 80 confined within the main fuel supply passage 58 and another end portion 82 which extends outwardly beyond the second end 74 and to which a handle 84 is attached.

A plunger piston 86 having a diameter which closely fits the internal diameter of the main fuel supply passage 58 is attached to the confined end portion 80 of the rod 76. The plunger piston 86 includes an O-ring 88 or other suitable resilient gasket to affect a sealing engagement between the plunger piston 86 and the interior of the main fuel supply passage 58. This sealing engagement blocks the passage of fuel through the main fuel supply passage 58 at the point where the plunger piston 86 is situated, while permitting the selective movement of the plunger piston 86 in the main fuel supply passage 58.

In this embodiment (and still referring only to FIG. 1), the intake end 64 of the inlet branch passage 60 communicates with the fuel chamber 34 of the carburetor 32, and the discharge end 66 of the inlet branch passage 60 communicates with the main fuel supply passage 58 generally between the first and second ends 72 and 74 but in a location which is spaced closer to the first end 72 of the main fuel supply passage 58 than to the second end 74.

Also in this embodiment, the intake end 68 of the outlet branch passage 62 communicates with the main fuel supply passage generally adjacent to its first end 72, and the discharge end 70 of the outlet branch passage 62 communicates with the air induction passage 42 intermediate the fuel metering orifice 46 of the first fuel delivery means 14 and the reed valve assembly 44.

When the rod 76 is positioned such that the plunger piston 86 is seated over the intake end 68 of the outlet branch passage 62 (shown in solid lines as position A in FIG. 1), the O-ring gasket 88 sealingly engages the interior of the main fuel supply passage 58 between the discharge end 66 of the inlet branch passage 60 and the intake end 68 of the outlet branch passage 62. The flow of fuel in the main fuel supply passage 58 between the inlet branch passage 60 and the outlet branch passage 62 is consequently blocked. This position of the plunger piston 86 corresponds to the heretofore described first position of the control means 54. Not only does the sealing engagement of the O-ring gasket 88 block fuel flow, but is also normally holds the plunger piston 86 in place, absent operator movement of the rod 76.

When the rod 76 is subsequently moved by the operator in the first direction away from the second end 74 of the main fuel supply passage 58 (as shown by solid line arrows in FIG. 1), the plunger piston 86 is moved away from the first end 72. When the rod 76 is positioned such that the plunger piston 86 is located generally intermediate the first and second ends 72 and 74 (shown in phantom lines as position B in FIG. 1), the flow of fuel between the discharge end 66 of the inlet passage 62 in the main fuel supply passage 58 is unobstructed. This position of the plunger piston 86 corresponds to the heretofore described second position of the control means 54. As before described, the sealing engagement of the O-ring gasket 88 serves to hold the plunger piston 86 in its second position, absent further movement of the rod 76 by the operator. When the plunger piston 86 is in its second position, fuel may pass through the passages 58, 60 and 62 in response to operation of the first fuel pumping means 50 from the fuel chamber 34 into the air induction passage 42 for delivery into the combustion chamber 12.

While the first fuel pumping means 50 may be variously constructed, in the embodiment shown in FIG. 1, in which the discharge end 70 of the outlet branch passage 62 communicates with the air induction passage 42, the pressure differential between the fuel chamber 34 and the air induction passage 42 occurring during engine piston reciprocation serves to draw fuel through the passages 58, 60 and 62 into the air induction passage 42 when the plunger piston 86 is in its second position, just as fuel is drawn into the air induction passage 42 through the first fuel delivery means 14. In the illustrated embodiment, a fuel metering orifice 90 is located in line with the outlet branch passage 62 to control the quantity of fuel which is ultimately emitted into the air induction passage 42 by the second fuel delivery means 16.

The fuel which is emitted by the outlet branch passage 62 into the air induction passage 42 is drawn through the reed valve assembly 44 along with the fuel which is emitted by the first fuel delivery means 14. Thus, the supply of fuel delivered to the combustion chamber 12 is enriched when the plunger piston 86 is in its second position and the engine 10 is operating. This enriched flow continues until the plunger piston 86 is subsequently moved in the second direction (as shown in phantom line arrows in FIG. 1) back to its first position (position A in FIG. 1).

Referring now to the operation of the associated second fuel pumping means 56, in the first embodiment, when the plunger piston 86 is progressively moved in the first direction from its second position toward the second end 74 of the main fuel supply passage 58 (as shown in solid line arrows in FIG. 1), open communication between the inlet branch passage 60 and the outlet branch passage 62 through the main fuel supply passage 58 is not affected. However, by virtue of the sealing engagement between the O-ring gasket 88 and the sidewall of the main fuel supply passage 58, the progressive movement of the plunger piston 86 from its second position toward the second end 74 serves to draw fuel into the main fuel supply passage 58. Movement of the plunger piston 86 in this direction proceeds until the plunger piston 86 reaches the second end 74 (shown in phantom lines as position C in FIG. 1), which position corresponds with the heretofore described third position of the control means 54.

When the plunger piston 86 is thereafter moved in the second direction (as shown by phantom line arrows in FIG. 1) from its third position back towards its second position, the sealing engagement of the O-ring gasket 88 serves to expel fuel out of the main fuel supply passage 58.

A spring 92 is provided to facilitate the return of the plunger piston 86 from its third position back to the second position. The spring 92 generally occupies the portion of the main fuel supply passage 58 between the second end 74 and the discharge end 66 of the inlet branch passage 60. Movement of the plunger piston 86 from its second position toward its third position will compress the spring 92 between the plunger piston 86 and the second end 74, and the subsequent expansion of the spring 92 will thus return the plunger piston 86 from its third position back toward its second position without the need of operator assistance.

As should now be apparent, the reciprocative movement of the plunger piston 86 in the first direction from the second position toward its third position, followed by the spring-assisted return of the plunger piston 86 in the second direction from its third position toward its second position serves to pump fuel successively into and then out of the main fuel supply passage 58 independent of operation of the first fuel pumping means 50.

To control the direction of fuel flow through the passages 58, 60 and 62 which together form the second fuel delivery means 16, the second fuel pumping means includes check valve means 94 which communicates with the inlet branch passage 60 and the outlet branch passage 62. Generally, during movement of the plunger piston 86 from its second position toward its third position, the check valve means 94 blocks the flow of fuel through the outlet branch passage 62 so that fuel is permitted to flow into the main fuel supply passage 58 only through the inlet branch passage 60. Conversely, during movement of the plunger piston 86 from its third position toward its second position, the check valve means 94 blocks the flow of fuel through the inlet branch passage 60 so that fuel flows out of the main fuel supply passage 58 only through the outlet branch passage 62. Thus, reciprocative movement of the plunger piston 86 between its second and third positions pumps fuel in a single direction from the fuel chamber into the air induction passage 42.

While the check valve means 94 may be variously constructed, in the illustrated embodiment, a check valve 96 and 98 of conventional construction is provided in each of the inlet and outlet branch passages 60 and 62. More particularly, an inlet check valve 96 communicates with the inlet branch passage 60 and is operative for permitting the flow of fuel in the inlet branch passage in a single direction from the fuel chamber 34 toward the main fuel supply passage 58, blocking the backflow of fuel in the inlet branch passage 60 from the main fuel supply passage 58 toward the fuel chamber 34. Likewise, an outlet check valve 98 communicates with the outlet branch passage 62 and is operative for permitting the flow of fuel in the outlet branch passage 62 in a single direction from the main fuel supply passage 58 toward the air induction passage 42, blocking the backflow of fuel in the outlet branch passage 62 from the air induction passage 42 toward the main fuel supply passage 58.

It should now be apparent that reciprocative movement of the plunger piston 86 between its second and third positions serves to prime the engine 10 before and during engine cranking operations. It should also now be apparent that movement of the plunger piston 86 between its first and second positions controls the enrichment of fuel delivered to the combustion chamber 12 during engine warm up or at other times when the engine 10 is operating and additional fuel is required to enhance engine performance.

A second alternate embodiment of the control means 54 and second fuel pumping means 56 is shown in solid lines in FIG. 2. Components which are common to the first described embodiment are assigned common reference numerals. Like the first described embodiment, the main fuel supply passage 58 forms a cylinder having a first end 72 and an oppositely spaced second end 74. A plunger piston 86 is also attached to the confined end portion 88 of the rod 76 for reciprocative movement within the main fuel supply passage 58 between the first and second ends 72 and 74. Also like the first embodiment, the inlet branch passage 60 communicates at its intake end 64 with the fuel chamber 34 of the carburetor 32 and at its discharge end 66 with the main fuel supply passage 58 near the first end 72.

However, unlike the first embodiment, the outlet branch passage 62 of the second embodiment communicates at its intake end 68 with the main fuel supply passage 58 adjacent to its second end 74 and is therefore oppositely spaced from the discharge end 66 of the inlet branch passage 60. Furthermore, in the second embodiment, the discharge end 68 of the outlet branch passage 60 communicates not with the air induction passage 42 but directly with the fuel induction port 48 of the combustion chamber 12.

More particularly, a nozzle 100 passes through an inlet port 102 formed in the block member 18 near the upper end 104 of the fuel induction port 48. The discharge end 70 of the outlet branch passage 62 communicates with the nozzle 100 so that fuel which is emitted by the outlet branch passage 62 through the nozzle 100 passes directly into the combustion chamber 12. This direct delivery into the combustion chamber 12 enhances the operation of the second fuel delivery means 18.

In the second embodiment, the plunger piston 86 is movable in the main fuel supply passage 58 between the three heretofore described operational positions. More particularly, when the plunger piston 86 is in the first position (shown by solid lines as position A in FIG. 2), the plunger piston 86 is located generally adjacent to the first end 72 of the main fuel supply passage 58 and between the discharge end 66 of the inlet branch passage 64 and the intake end 68 of the outlet branch passage 62. When the plunger piston 86 is located in the second position (shown by phantom lines as position B in FIG. 2), the plunger piston 86 is located generally equidistant between the discharge end 66 of the inlet branch passage 60 and the intake end 64 of the outlet branch passage 62. When the plunger piston 86 is located in the third position (shown by phantom lines as position C in FIG. 2), the plunger piston 86 is located generally adjacent to the second end 74 of the main fuel supply passage 58 and between the discharge end 66 of the inlet branch passage 58 and the intake end 68 of the outlet branch passage 62.

In the second embodiment, an auxiliary passage 110 is formed within the confined end 80 of the rod 76. The auxiliary passage has a first open end 112 which communicates with the chamber portion 106 of the main fuel supply passage 58 formed between the plunger piston 86 and the first end 72. Since the inlet branch passage 60 also communicates with this chamber portion 106, it will hereafter be referred to as the inlet chamber portion.

The auxiliary passage 110 has a second open end 116 which communicates with another chamber portion 108 of the main fuel supply passage 58 formed between the plunger piston 86 and the second end 74. Since the outlet branch passage 62 communicates with the chamber portion 108, it will hereafter be referred to as the outlet chamber portion.

It should now be apparent that, due to the movement of the plunger piston 86 between the inlet branch passage 60 and the outlet branch passage 62, communication between the inlet chamber portion 106 and the outlet chamber portion 108 of the main fuel supply passage 58, and thus between the inlet branch passage 60 and the outlet branch passage 62, is provided only by the auxiliary passage 110. In this second embodiment, means 114 is provided for blocking the communication between the inlet chamber portion 106 and the outlet chamber portion 108 through the auxiliary passage 110 when the plunger piston 86 is in its first position and for affording communication between the inlet chamber portion 106 and the outlet chamber portion 108 through the auxiliary passage 110 when the plunger piston 86 is in its second and third positions. In this way, control of the flow of fuel through the second fuel delivery means 16 illustrated in FIG. 2 is achieved.

While the means 114 may vary in construction, in the illustrated embodiment, the main fuel supply passage 58 includes a restricted interior end portion 118 extending from its first end 72 to the point where the discharge end 66 of the inlet branch passage 60 communicates with the inlet chamber portion 106. The plunger piston 86 includes a first O-ring gasket 88 which effects a sealing engagement between the plunger piston 86 and the interior of the main fuel supply passage 58 between the discharge end 66 of the inlet branch passage 60 and the intake end 68 of the outlet branch passsage 62, as well as a second O-ring gasket 89 which effects a sealing engagement between the plunger piston 86 and the restricted interior end portion 118.

When the plunger piston 86 is located in its first position (that is, position A in FIG. 2), the O-ring 88 sealing engages the interior of the main fuel supply passage 58 between the inlet branch passage 60 and the outlet branch passage 62 while the O-ring 89 sealing engages the restricted interior end portion 118 between the inlet branch passage 60 and the first open end 112 of the auxiliary passage 110. Thus, the flow of fuel through the inlet branch passage 60 either toward the outlet chamber portion 106 of the main fuel supply passage 58 or toward the first open end 112 of the auxiliary passage is blocked. Thus, when the plunger piston 86 is in its first position, the flow of fuel from the fuel chamber 34 into the combustion chamber 12 is blocked.

When the plunger rod 76 is subsequently moved in the first direction (as shown in solid arrows in FIG. 2) outwardly of the second end 74 of the main fuel supply passage 58, the plunger piston 86 is moved toward the second end 74. The sealing engagement between the O-ring 89 and the restricted interior portion 118 of the main fuel supply passage 58 ceases, whereas the sealing engagement the O-ring 88 and the remaining portion of the interior of the main fuel supply passage 58 continues. When the plunger piston 86 assumes its second position (shown in phantom lines as position B in FIG. 2), the first end 112 of the auxiliary passage 110 thus communicates with the discharge end 66 of the inlet branch passage 60. Communication between the discharge end 66 of the inlet branch passage 60 and the intake end 68 of the outlet branch passage 62 is thereby afforded through the auxiliary passage 110.

Thus, when the plunger piston 86 is in its second position, operation of the first fuel pumping means 50 causes fuel to flow through the passages 58, 60, 62 and 110 which form the second fuel delivery means 16 of the second embodiment.

In the second embodiment, the first fuel pumping means 50 takes the form of pulsating pressure variations which occur in the crankcase 22 as a result of piston reciprocation and pump the fuel from the fuel chamber 34 of the carburetor 32 into the combustion chamber 12 through the illustrated second fuel delivery means 16.

An outlet check valve 98 is employed to assure that the flow of fuel through the passages 58, 60, 62 and 110 proceeds in a single direction from the fuel chamber 34 into the combustion chamber 12. More particularly, in the second embodiment, and like the first embodiment, the outlet check valve 98 communicates with the outlet branch passage 62 and is operative for permitting fuel to flow in the outlet branch passage 62 only toward the combustion chamber 12.

By virtue of this arrangement, when the plunger piston 86 is in its second position, the pressure pulses occurring in the crankcase 22 during the upstroke of the engine piston 24 are operative for drawing fuel from the fuel chamber 34 through the nozzle 100 into the combustion chamber 12. The outlet check valve 98 opens to permit this forward flow. However, the pressure pulses occurring in the crankcase 22 during the downstroke of the engine piston 24 are operative for pumping fuel away from the combustion chamber 12 toward the fuel chamber 34. The outlet check valve 98 closes to prevent this backflow into the outlet chamber portion 108 of the main fuel supply passage 58.

Referring now to the operation of the associated second fuel pumping means 56 in the second embodiment, as in the first described embodiment, reciprocative movement of the plunger piston 86 between its second and third position serves to pump fuel from the fuel chamber 34 into the combustion chamber 12. More particularly, the second fuel pumping means 56 is generally operative for drawing fuel from the fuel chamber 34 into the inlet chamber portion 106 of the main fuel supply passage 58 through the inlet branch passage 60 while simultaneously expelling fuel from the outlet chamber portion 108 of the main fuel supply passage 58 through the outlet branch passage 62 in response to movement of the plunger piston 86 from the second position (that is, position B in FIG. 2) toward the third position (that is, position C in FIG. 2). Furthermore, the second fuel pumping means 56 is generally operative for drawing fuel through the auxiliary passage 110 from the inlet chamber portion 106 into the outlet chamber portion 108 in response to movement of the plunger piston 86 from its third position back toward its second position.

More particularly, in addition to the heretofore described outlet check valve 98, the second fuel pumping means 50 also includes an inlet check valve 96 which communicates with the auxiliary passage 110. The inlet check valve 96 is operative for permitting the flow of fuel in the auxiliary passage 110 from the inlet chamber portion 106 toward the outlet chamber portion 108, but blocks the flow of fuel from the outlet chamber portion 108 toward the inlet chamber portion 106.

More particularly, when the plunger piston 86 is moved from its second position toward its third position, a series of operative events occur. First, movement of the plunger piston 86 toward the second end 74 serves to close the inlet check valve 96 to prevent the passage of fuel through the auxiliary passage 110 from the outlet chamber portion 108 into the inlet chamber portion 106. Simultaneously, movement of the plunger piston 86 toward the second end 74 serves to open the outlet check valve 98 to expel fuel confined in the outlet chamber portion 108 out through the outlet branch passage 62. Also simultaneously, movement of the plunger piston 86 away from the first end 72, serves to draw fuel from the fuel chamber 34 into the inlet chamber portion 106.

When the plunger piston 86 is subsequently moved from its third position back toward its second position, the inlet check valve 96 opens to permit a portion of the fuel then occupying the inlet chamber portion 106 to be drawn through the auxiliary passage 110 into the outlet chamber portion 108. The successive movement of the plunger piston 86 from its second position back toward its third position expels this fuel from the outlet chamber portion 108, while at the same time drawing fuel into the inlet chamber portion 106 to replenish the supply of fuel therein.

As in the first described embodiment, the return of the plunger piston 86 from its third position toward its second position is facilitated by a spring 92 which generally occupies the outlet chamber portion 108 and which is compressed between the plunger piston 86 and the second end 74 of the main fuel supply passage 58 during movement of the plunger piston 86 from the second position toward its third position. Subsequent expansion of the spring 92 returns the plunger piston 86 from its third position back toward its second position.

While the sealing engagement of the O-ring gaskets 88 and 89 with the interior of the main fuel supply passage 58 is normally sufficient to maintain the plunger piston 86 in its first position absent operator movement of the plunger rod 76, in the second embodiment, means 120 is provided to more positively secure the plunger piston 86 in its first position. While the means 120 may be variously constructed, in the illustrated embodiment, two oppositely spaced, resilient fingers 124 extend outwardly from the second end 74 of the main fuel supply passage 58. Each finger 124 includes an inwardly projecting tab member 126 which projects from the finger 124 toward the plunger rod 76.

The plunger handle 84 includes a generally concave exterior groove 128. When the plunger piston 86 is located in its first position, (as is shown in solid lines in FIG. 2), the tab members 126 of the resilient fingers 124 are located in snap-fit engagement with the groove 128. The plunger piston 86 is thereby positively secured in its first position. The resilient nature of the fingers 124 permit selective snap-fit engagement and disengagement between the groove 128 and the tab members 126 during movement of the plunger piston 86 between its first position and its second position.

When the plunger piston 86 is in its second position (shown in phantom lines as position B in FIG. 2), the lower edge 130 of the handle 84 abuts against the outer edge 131 of the fingers 124. By virtue of this construction, the outer edge 131 of the fingers 124 acts as a positive stop which consistently locates the plunger piston 86 in its second position, both during manual movement of the plunger piston 86 from its first position towards its second position as well as during the spring assisted return of the piston plunger 86 from its third position back toward its second position.

The invention is applicable for use with engines having more than one combustion chamber. In this embodiment, and as is shown in phantom lines in FIG. 2, the outlet branch passage 62 has an intake end 68 which communicates with the outlet chamber portion 108 of the main fuel supply passage 58 and a first discharge end 70 which communicates with the first described combustion chamber 12 (shown in solid lines in FIG. 2) and a second discharge end 70*a* which communicates with an associated second combustion chamber 12*a* (shown in phantom lines in FIG. 2).

Inasmuch as piston reciprocation in the first combustion chamber 12 usually is opposite to that in the second combustion chamber 12*a* (that is, as the piston 24 in the first combustion chamber 12 is in its upstroke, the piston 24*a* in the second combustion chamber 12*a* is in its downstroke, and vice versa), the single outlet check valve 98 of the first and second embodiments may be replaced by two outlet check valves 132 and 134 which individually communicate with the first discharge end 70 and the second discharge end 70*a* of the outlet branch passage 62. Each outlet check valve 132 and 134 is operative to permit fuel to flow toward the associated discharge end 70 and 70*a* into the respective combustion chamber 12 and 12*a* during the upstroke of the associated piston 24 and 24*a*, but prevents the backflow of fuel from the associated discharge end 70 and 70*a* into the outlet chamber portion 108 of the main fuel supply passage 58 during the downstroke of the associated piston 24 and 24*a*.

Thus, when the plunger piston 86 is in its second position, fuel flows from the fuel chamber 34 alternatively into the first and second combustion chambers 12 and 12*a* in response to piston reciprocation therein. Also, reciprocative movement of the plunger piston 86 between its second position and its third position will serve to pump fuel simultaneously into both the first and second combustion chambers 12 and 12*a*.

It is to be appreciated that the three embodiments described are not intended to show mutually exclusive constructions. That is, all or part of the particular construction of the control means 54 and associated second fuel pumping means 58 shown in the first embodiment is applicable for use in both the second and third embodiments, and vice versa.

Various of the features of the invention are set forth in the following claims.

I claim:

1. An engine comprising a combustion chamber, first fuel delivery means communicating with said combustion chamber and adapted for connection with a fuel source, said first fuel delivery means being operative for introducing fuel from the source into said combustion chamber, second fuel delivery means communicating with said combustion chamber and adapted for connection with a fuel source, said second fuel delivery means being operative for introducing fuel into said combustion chamber in addition to the fuel introduced by said first fuel delivery means and including first fuel pumping means for pumping fuel through said second fuel delivery means to said combustion engine, and means movable independently of said first fuel pumping means and located in said second fuel delivery means for controlling the introduction of fuel into said combustion chamber by said second fuel delivery means during operation of said first fuel pumping means and for pumping fuel through said second fuel delivery means to said combustion chamber in response to movement of said independently movable means in said second fuel delivery means.

2. An engine according to claim 1 wherein said means movable in said second fuel delivery means includes control means operatively movable in a first direction for permitting the introduction of fuel into said combustion chamber by said second fuel delivery means during operation of said first fuel pumping means and in a second direction for blocking the introduction of fuel into said combustion chamber by said second fuel delivery means notwithstanding operation of said first fuel pumping means, and second fuel pumping means operatively connected with said control means for pumping fuel through said second fuel delivery means independent of operation of said first fuel pumping means in response to sequential movement of said control means in said first direction and in said second direction.

3. An engine according to claim 2 wherein control means is movable between a first position blocking the introduction of fuel into said combustion chamber by said second fuel delivery means, a second position spaced in said first direction from said first position and permitting the introduction of fuel into said combustion chamber by said second fuel delivery means, and a third position spaced in said first direction from said second position and permitting the introduction of fuel into said combustion chamber by said second fuel delivery means, and wherein said second fuel pumping means is operable in response to sequential movement of said control means in said first direction from said second position toward said third position and in said second direction from said third position toward said second position.

4. An engine according to claim 3 wherein said second fuel delivery means includes a main fuel supply passage, an inlet branch passage having an intake end communicating with the source and a discharge end communicating with said main fuel supply passage, and an outlet branch passage having an intake end communicating with said fuel supply passage and a discharge end communicating with said combustion chamber, and wherein said control means is movable in said main fuel supply passage between said first position preventing communication between said inlet branch passage and said outlet branch passage, said second position affording communication between said inlet branch passage and said outlet branch passage, and said third position affording communication between said inlet branch passage and said outlet branch passage.

5. An engine according to claim 4 wherein said second fuel pumping means includes means for drawing fuel from the source into said main fuel supply passage through said inlet branch passage in response to movement of said control means from said second position toward said third position and for expelling fuel from said main fuel supply passage into said combustion chamber through said outlet branch passage in response to movement of said control means from said third position toward said second position.

6. An engine according to claim 5 wherein said means for drawing fuel into and expelling fuel out of said main fuel supply passage includes check valve means communicating with said inlet branch passage and said outlet branch passage for blocking the flow of fuel in said outlet branch passage while permitting the flow of fuel in said inlet branch passage from the source into said main fuel supply passage in response to movement of said control means from said second position toward said third position and for blocking the flow of fuel in said inlet branch passage while permitting the flow of fuel in said outlet branch passage from said main fuel supply passage into said combustion chamber in response to movement of said control means from said third position toward said second position.

7. An engine according to claim 6 wherein said check valve means includes inlet check valve means communicating with said inlet branch passage and operative for permitting the flow of fuel in said inlet branch passage from the source toward said main fuel supply passage while blocking the flow of fuel in said inlet branch passage from said main fuel supply passage toward the source.

8. An engine according to claim 6 wherein said check valve means includes outlet check valve means communicating with said outlet branch passage and operative for permitting the flow of fuel in said outlet branch passage from said main fuel supply passage into said combustion chamber while blocking the flow of fuel in said outlet branch passage from said combustion chamber toward said main fuel supply passage.

9. An engine according to claim 4 wherein said main fuel supply passage includes oppositely spaced first and second ends, wherein said discharge end of said inlet branch passage communicates with said main fuel supply passage generally intermediate said first end and said second end, and wherein said intake end of said outlet branch passage communicates with said main fuel supply passage generally adjacent to said first end.

10. An engine according to claim 9 wherein said control means includes a piston including a piston rod extending from said piston through said second end of said main fuel supply passage, said piston being movable in said main fuel supply passage between said first position in which said piston is located generally adjacent to said first end of said main fuel supply passage between said inlet branch passage and said outlet branch passage thereby blocking communication between said inlet branch passage and said outlet branch passage, said second position in which said piston is located between said inlet branch passage and said second end thereby affording communication between said inlet branch passage and said outlet branch passage, and said third position in which said piston is located generally adjacent to said second end of said main fuel supply passage.

11. An engine according to claim 4 wherein said main fuel supply passage includes oppositely spaced first and second ends, wherein said discharge end of said inlet branch passage communicates with said main fuel supply passage generally adjacent to said first end, and wherein said intake end of said outlet branch passage communicates with said main fuel supply passage generally adjacent to said second end.

12. An engine according to claim 11 wherein said control means includes a piston movable in said main fuel supply passage between said first position in which said piston is located generally adjacent to said first end of said main fuel supply passage and between said inlet branch passage and said outlet branch passage, said second position in which said piston is generally equally spaced between said inlet branch passage and said outlet branch passage, and said third position in which said piston is generally located adjacent to said second end of said main fuel supply passage and between said outlet branch passage and said inlet branch passage, said piston including a piston rod extending from said piston through said second end of said main fuel supply passage, said piston rod having an auxiliary passage formed therein extending between a first open end communicating with an inlet chamber portion of said main fuel supply passage formed between said piston and said first end and a second open end communicating with an outlet chamber portion of said main fuel supply passage formed between said piston and said second end, and means for blocking the communication between said inlet chamber portion and said outlet chamber portion through said auxiliary passage when said piston is in said first position, thereby blocking communication between said inlet branch passage and said outlet branch passage, and for affording communication between said inlet chamber portion and said outlet chamber portion through said auxiliary passage when said piston is in said second position and said third position, thereby affording communication between said inlet branch passage and said outlet branch passage through said auxiliary passage.

13. An engine according to claim 12 wherein said second fuel pumping means includes means for drawing fuel from the source into said inlet chamber portion through said inlet branch passage while simultaneously expelling fuel from said outlet chamber portion into said combustion chamber through said outlet branch passage in response to movement of said piston from said second position toward said third position and for drawing fuel through said auxiliary passage from said inlet chamber portion of said main fuel supply passage into said outlet chamber portion of said main fuel supply passage in response to movement of said piston from said third position toward said second position.

14. An engine according to claim 13 wherein said means for drawing fuel into and expelling fuel out of said main fuel supply passage includes check valve means communicating with said auxiliary passage and said outlet branch passage for blocking the flow of fuel in said auxiliary passage while permitting the flow of fuel in said inlet branch passage from the source into said inlet chamber portion of said main fuel supply passage and the flow of fuel in said outlet branch passage from said outlet chamber portion of said main fuel supply passage into said combustion chamber in response to movement of said piston from said second position toward said third position and for blocking the flow of fuel in said outlet branch passage while permitting the flow of fuel in said auxiliary passage from said inlet chamber portion into said outlet chamber portion in response to movement of said piston from said third position toward said second position.

15. An engine according to claim 14 wherein said check valve means includes inlet check valve means communicating with said auxiliary passage and operative for permitting the flow of fuel in said auxiliary passage from said inlet chamber portion of said main fuel supply passage toward said outlet chamber portion of said main fuel supply passage while blocking the flow of fuel in said auxiliary passage from said outlet chamber portion toward said inlet chamber portion.

16. An engine according to claim 14 wherein said check valve means includes outlet valve means communicating with said outlet branch passage and operative for permitting the flow of fuel in said outlet branch passage from said outlet chamber portion of said main fuel supply passage into said combustion chamber while blocking the flow of fuel in said outlet branch passage from said combustion chamber toward said outlet chamber portion of said main fuel supply passage.

17. An engine according to claim 3 wherein said control means includes spring means for returning said control means from said third position toward said second position.

18. An engine according to claim 3 wherein said control means includes locking means for securing said control means in said first position.

19. An engine according to claim 1 wherein said first fuel pumping means includes a source of pulsating pressure and means operatively connecting said second fuel delivery means with said source of pulsating pressure for pumping fuel through said second fuel delivery means in response to pulsating pressure.

20. An engine according to claim 1 wherein said first fuel delivery means includes a carburetor having a fuel chamber communicating with the fuel source, and wherein said second fuel delivery means has an inlet end communicating with said fuel chamber and an outlet end communicating with said combustion chamber.

21. An engine according to claim 20 wherein said combustion chamber includes a sidewall having an inlet port passing therethrough, and wherein said outlet end of said second fuel delivery means includes nozzle means communicating with said inlet port of said combustion chamber for introducing fuel into said combustion chamber through said inlet port.

22. An engine according to claim 20 wherein said carburetor includes an air induction passage communicating with the atmosphere and with the combustion chamber, and wherein said outlet end of said second fuel delivery means communicates with said air induction passage for introducing fuel into said air induction passage.

23. An engine according to claim 1 and further including a second combustion chamber in addition to said first mentioned combustion chamber, wherein said first fuel delivery means and said second fuel delivery means communicate with said first and second combustion chambers, wherein said first fuel pumping means is operative for pumping fuel through said second fuel delivery means into said first and second combustion chambers, and wherein said means movable in said second fuel delivery means is operative for controlling the introduction of fuel into said first and second combustion chambers by said second fuel delivery means and for pumping fuel simultaneously into said first and second combustion chambers in response to movement of said means in said second fuel delivery means.

* * * * *